US009155446B2

(12) United States Patent
Bennett et al.

(10) Patent No.: US 9,155,446 B2
(45) Date of Patent: Oct. 13, 2015

(54) DISHWASHER DOOR MOUNTED DISPENSER ASSEMBLY

(75) Inventors: Aaron P. Bennett, Saint Joseph, MI (US); Paul E. Beshears, Jr., Stevensville, MI (US); Michael F. Gregory, Saint Joseph, MI (US); Richard L. Kretz, Findlay, OH (US); Elliott V. Stowe, Stevensville, MI (US); Christopher C. Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 681 days.

(21) Appl. No.: 13/547,345

(22) Filed: Jul. 12, 2012

(65) Prior Publication Data

US 2014/0014144 A1 Jan. 16, 2014

(51) Int. Cl.
*A47L 15/44* (2006.01)
*A47L 15/42* (2006.01)

(52) U.S. Cl.
CPC ..... *A47L 15/4409* (2013.01); *A47L 15/4257* (2013.01); *Y10T 29/494* (2015.01)

(58) Field of Classification Search
None
See application file for complete search history.

(56) References Cited

U.S. PATENT DOCUMENTS

| | | | |
|---|---|---|---|
| 5,176,297 | A | 1/1993 | Mooney et al. |
| 5,211,188 | A | 5/1993 | Kraus |
| 6,189,551 | B1 | 2/2001 | Sargeant et al. |
| 6,401,733 | B1 | 6/2002 | Schrott et al. |
| 6,474,351 | B1 | 11/2002 | Cerruti et al. |
| 6,622,896 | B2 | 9/2003 | Hegeman et al. |
| 7,302,956 | B2 | 12/2007 | Cerruti et al. |
| 7,909,938 | B2 | 3/2011 | Cerruti et al. |
| 2010/0148644 | A1 | 6/2010 | Poyner et al. |

*Primary Examiner* — Jason Ko

(57) ABSTRACT

A dishwasher includes a dispenser assembly, having a top plate portion and a rear plate portion, mounted to a dishwasher liner through at least one mechanical fastener which projects through the liner, extends freely through the rear plate portion and is secured to the top plate portion. Disposed between the liner and the rear panel portion is a seal, either a flat seal or a radial seal. In addition, a trim member, which can be hinged to the top plate portion or formed as a separate component, is provided about a periphery of the top plate portion and seats upon the liner.

24 Claims, 3 Drawing Sheets

DISHWASHER DOOR MOUNTED DISPENSER ASSEMBLY

BACKGROUND OF THE INVENTION

1. Field of the Invention

The present invention pertains to the art of dishwashers and, more particularly, to the mounting of a dispenser assembly on an inner liner of a dishwasher.

2. Discussion of the Related Art

It is common in the art of dishwashers to provide a detergent dispenser for use in the dispersion of a rinse aid and/or washing detergent for a washing operation. One known arrangement provides a dispenser mounted to the inner door liner of the dishwasher. With this configuration, the dispenser is conveniently located in a horizontal configuration for filling purposes and a vertical configuration for dispensing operations.

Certainly, there are various ways to design a detergent dispenser of this type. For instance, it is known to form the dispenser from two parts, i.e., a top plate portion and a rear plate portion, which are welded together. Screws are driven into the rear plate through a gasket to sealingly attach the dispenser to the inner door liner of the dishwasher. In such an arrangement, the screws need to be driven tight enough to avoid leaving a cosmetic gap between the dispenser and the door liner which is not appealing. In addition, the gap can trap water and food soil which can leave streaks down the door following a washing cycle. On the other hand, if the screws are driven in too tight, the attachment can pull the two parts of the dispenser apart, resulting in the potential for leakage. As electrical wiring is often routed through a dishwasher door and certain washing fluids, including rinse aid, can attack wire insulation, it is important for the dispenser construction and mounting be configured to address these concerns. Despite known prior designs, a dispenser mounting arrangement which assures the long term integrity, provides enhanced aesthetics and maintains a superior degree of cleanliness for the overall dispenser would be a welcomed enhancement.

SUMMARY OF THE INVENTION

In general, the invention is directed to a dishwasher including a tub defining a washing chamber within which kitchenware is adapted to be supported for a washing operation. More particularly, the invention is directed to the mounting of a rinse aid and/or detergent dispenser assembly to an inner panel or liner which defines, at least in part, the washing chamber of the dishwasher.

In accordance with the invention, the detergent dispenser is formed from two main components, i.e., a top plate portion which is exposed to the washing chamber and a rear plate portion. The top and rear plate portions are assembled together, preferably by hot welding plastic top and rear plate portions together. The rear plate portion is formed with flange portions which seat upon a mounting ledge portion of the inner liner. In accordance with a preferred embodiment of the invention, the mounting ledge portion of the inner liner is recessed relative to a main panel portion of the inner liner, with the rear plate portion extending into the body of the door. Mechanical fasteners, such as screws, are employed to mount the dispenser assembly to the inner liner, with the mechanical fasteners extending freely through clearance holes provided in the rear plate portion and being secured, such as by threading, to bosses of the top plate portion, thereby avoiding stress on any fastener bosses in the rear plate portion that could cause cracking leading to rinse aid or other leaks.

In accordance with another aspect of the invention, a primary seal is provided between the inner liner and the rear plate portion of the dispenser assembly. In addition, a second gasket is arranged between the rear plate portion and the inner liner. In one embodiment, a face seal, through which the mechanical fasteners extend, is interposed between the mounting ledge portion of the inner liner and the rear plate portion of the dispenser assembly. In another embodiment, a radial gasket arrangement is positioned between an outer periphery of the rear plate portion and the inner liner.

In accordance with a further aspect of the invention, the top plate portion of the dispenser assembly is provided with a peripheral trim member. In accordance with one embodiment, the peripheral trim member is constituted by a flexible skirt defined by a thin flange section extending outwardly at an angle from a periphery of the top plate portion, with the flexible skirt being connected to the top plate portion through a living hinge. In another embodiment, the trim member is constituted by a separate, preferably elastomeric component which snaps or is otherwise attached about the top plate portion. In either version, the trim member extends along the inner liner and covers any gap between the inner liner and the dispenser assembly.

The various aspects of the invention combine synergistically to provide long term sealing and assure an overall aesthetic mounting arrangement for the dispenser assembly. In any case, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE INVENTION

Figure 1:
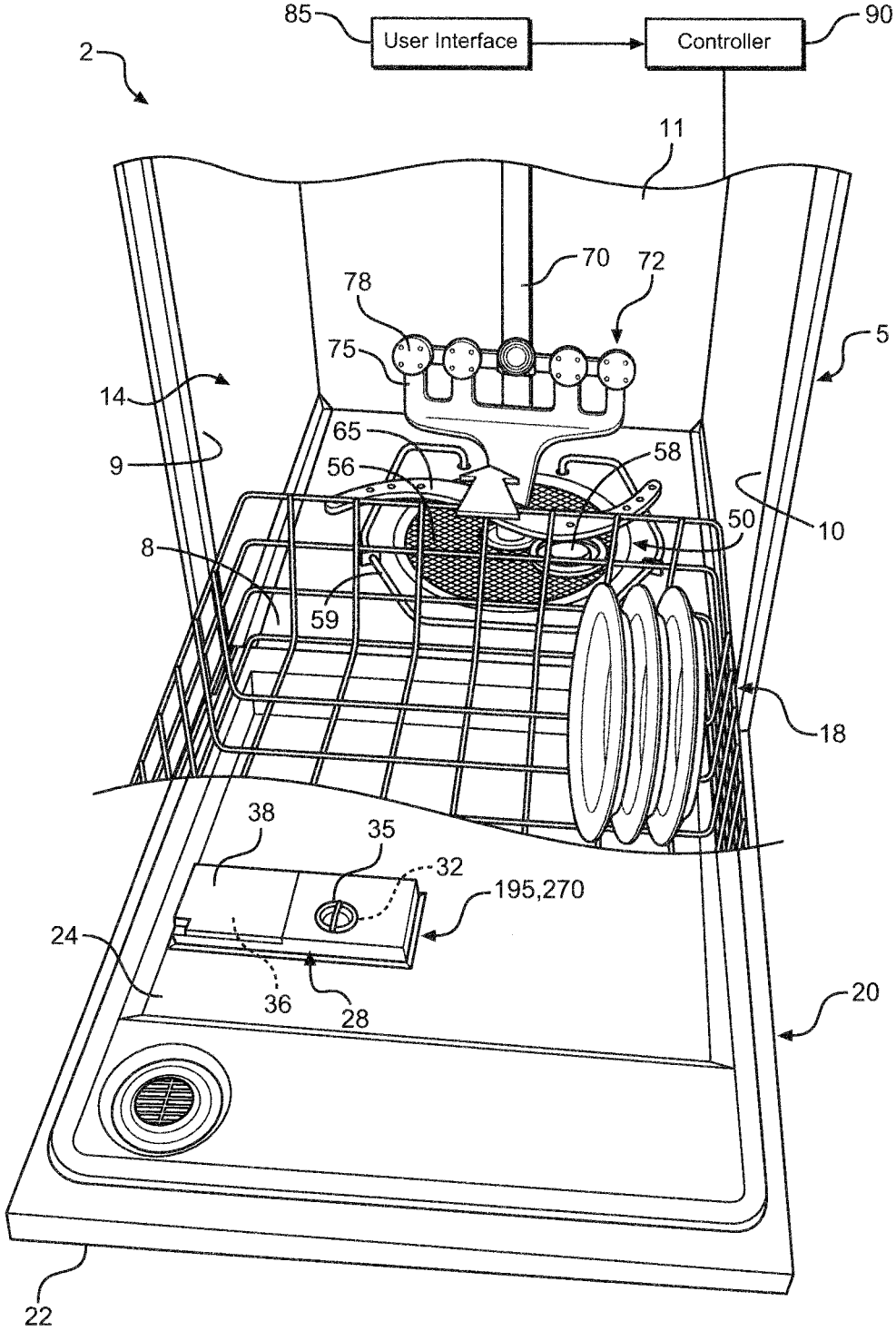
FIG. 1 is a perspective view of a dishwasher incorporating the dispenser assembly of the invention.

With initial reference to FIG. 1, a dishwasher for use with the present invention is indicated at 2. As shown, dishwasher 2 includes a tub 5 which is preferably molded of plastic so as to include integral bottom, side and rear walls 8-11 respectively, as well as a top wall (not shown). At this point, it should be recognized that tub 5 could be made from various materials, including plastics or stainless steel. Within the confines of walls 8-11, tub 5 defines an interior washing chamber 14 within which soiled kitchenware is adapted to be placed, such as upon a shiftable lower rack 18 and/or an upper rack (not shown), with the kitchenware being cleaned during a washing operation. Tub 5 has attached thereto a frontal frame (not labeled) which pivotally supports a door 20 used to seal washing chamber 14 during the washing operation. In connection with the washing operation, door 20 is formed from an outer panel 22 and an inner liner 24, which actually defines, in part, washing chamber 14. Mounted to inner liner 24 is a dispenser assembly 28 including a rinse aid container 32, within which a consumer can place a rinse aid upon removal of a cap 35, and a detergent container 36, which is arranged below a pivoting lid 38 and into which a consumer can place a liquid or particulate washing detergent, for dispensing at predetermined portions of the washing operation. As will be detailed more fully below, the present invention is specifically directed to the mounting of dispenser assembly 28 to inner liner 24.

Disposed within washing chamber 14 is a pump and filtration assembly generally indicated at 50. In the preferred embodiment illustrated in this figure, pump and filtration assembly 50 includes a radially extending strainer 56 and a removable filter unit 58. Extending about a substantial portion of pump and filtration assembly 50, at a position raised above bottom wall 8, is a heating element 59. Heating element 59 preferably takes the form of a sheathed, electric resistance-type heating element. In a manner known in the art, pump and filtration assembly 50 is adapted to recirculate washing fluid to at least a lower wash arm 65 having spaced nozzles (not labeled), a conduit 70 which leads to an upper spray arm (not shown) and, in the embodiment shown, an auxiliary, fluid distribution or spray unit 72 having a manifold 75 which distributes washing fluid to a series of rotatable spray heads 78.

Basically, the structure of dishwasher 2 described to this point is known in the art and does not form part of the present invention such that this description is simply provided for the sake of completeness. As also widely known in the art, dishwasher 2 is adapted to perform a washing operation with a user selecting desired operation parameters through a user interface 85. That is, upon shutting door 20 to seal washing chamber 14 and initiating the start of the washing operation through a controller 90, the operation of pump and filtration assembly 50 and heating element 59 are regulated by controller 90 in order to direct heated washing fluid upon kitchenware placed on at least rack 18. During select portions of the washing operation, dispenser assembly 28 will open in order to add rinse aid and/or detergent to the washing fluid for cleansing purposes. Also, if tough stains are expected and the user selects a tough scrubbing washing operation, a portion of the washing fluid from pump and filtration assembly 50 will be directed to auxiliary spray unit 72 during a predetermined stage of the washing operation in order to provide a high pressure, intense washing action in at least a rear portion or intensified wash zone of rack 18.

Figure 2:
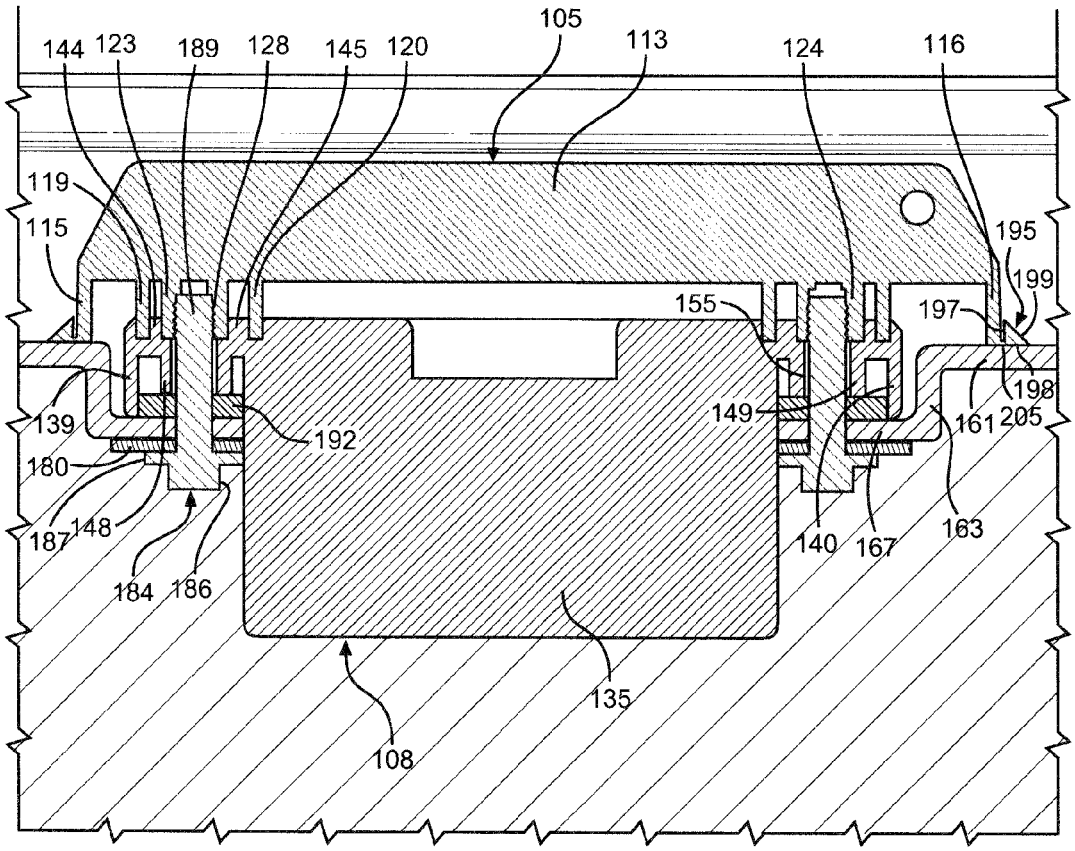
FIG. 2 a cross-sectional view of one embodiment of the dispenser assembly of the invention.

Again, this general operation of dishwasher 2 is known in the art and the detailed description thereof is only being provided for the sake of completeness. Of particular importance in connection with the present invention is the construction and mounting of dispenser assembly 28. With particular reference to FIG. 2, the construction of dispenser assembly 28 in accordance with one embodiment of the invention will now be described. As shown, dispenser assembly 28 includes a top plate or cover portion 105 and a bottom or rear plate portion 108. At this point, it should be noted that top plate portion 105 and rear plate portion 108 initially constitute individual components of dispenser assembly 28 which can be completely separate or, as in the most preferred embodiment, made of plastic and hot welded together. In any case, top plate portion 105 is shown to include a main body 113 having peripheral support legs, including support legs 115 and 116. In addition, further extending from main body 113 are annular mounting legs 119 and 120, as well as various spaced bosses 123 and 124. Each of bosses 123 and 124 has an inner diametric portion 128 that is internally threaded. Like top plate portion 105, rear plate portion 108 includes a main body 135 having support legs 139 and 140. In addition, main body 135 is formed with various upstanding mounting legs, such as that indicated at 144 and 145, as well as bosses 148 and 149. As shown, each of bosses 148 and 149 is provided with a bore or through hole 155.

In accordance with the invention, various configurations can be taken for inner liner 24. In the embodiment depicted, inner liner 24 includes a main body portion 161 that leads to a down-turned or in-turned portion 163 followed by a mounting flange portion 167. As clearly shown in these figures, top plate portion 105 and rear plate portion 108 are interengaged, particularly with upstanding mounting legs 144 and 145 of rear plate portion 108 extending between respective ones of mounting legs 119 and 120, as well as bosses 123 and 124. As indicated above, the most preferred form of the invention has top plate portion 105 and rear plate portion 108 hot welded together such that upstanding mounting legs 144 and 145 are welded to respective ones of mounting legs 119, 120 and bosses 123, 124.

As shown, dispenser assembly 28 is positioned on inner liner 24 such that at least support legs 139 and 140 of rear plate portion 108 rest upon mounting flange portion 167 while main body 135 of rear plate portion 108 projects or extends through inner liner 24. At the same time, support legs 115 and 116 of top plate portion 105 rest upon main body portion 161 of inner liner 24. Once positioned in this fashion, dispenser assembly 28 is secured to inner liner 24 with a primary seal 180 located on one side of mounting flange portion 167. More specifically, a plurality of mechanical fasteners 184, each of which includes a head 186, a washer 187 and a shaft 189, are employed to fix dispenser assembly 28 to inner liner 24. In particular, each mechanical fastener 184 extends through primary seal 180 and mounting flange portion 167 of inner liner. In accordance with a first embodiment of the invention as shown in FIG. 2, each mechanical fastener 184 then extends through a face seal 192 that is positioned between mounting flange portion 167 and bosses 148 and 149 of rear plate portion 108. Thereafter, mechanical fasteners 184 extend freely through a respective bore 155 of each boss 148, 149 before being threadably attached to a respective boss 123, 124 of top plate portion 105.

At this point, certain particular aspects of the present invention should be noted. That is, first of all, mechanical fasteners 184, such as screws, are employed to mount dispenser assembly 28 to inner liner 24, with mechanical fasteners 184 extending freely through the clearance holes or bores 155 established in bosses 148 and 149 of rear plate portion 108, while being secured, such as by threading, to the bosses 123 and 124 of the top plate portion 105, thereby avoiding stress on bosses 148 and 149 of rear plate portion 108. This arrangement advantageously devoids the stress on the parts of rear plate portion 108 which could cause cracking and lead to rinse aid or other leaks. Second, it is important to note the positioning of the secondary face seal 192 between rear plate portion 108 and inner liner 24. In this embodiment, face seal 192, through which the mechanical fasteners 184 extend, is interposed between the mounting flange or ledge portion 167 of inner liner 24 and rear plate portion 108 of dispenser assembly 28. Therefore, in addition to specifically avoiding having mechanical fasteners 184 secured directly to rear plate portion 108 but instead having mechanical fasteners 184 sandwich rear plate portion 108 between top plate portion 105 and inner liner 24, the dual seal arrangement of primary seal 180 and face seal 192 effectively prevents any leakage rinse aid or detergent into the space between outer panel 22 and inner liner 24 of door 20 which may contain electrical components and wiring.

In accordance with another aspect of the invention, it should be recognized that inner liner 24 will likely not be perfectly flat such that gaps can exist between support legs 115 and 116 of top plate portion 105 of dispenser assembly 28 and inner liner 24. These gaps can generally range in the order of 1-2 mm. Certainly, these gaps are not considered to be aesthetically pleasing, but also water and food soil can seep into or become lodged between these components and then drip out once door 20 is closed, thereby leaving unsightly streaks on inner liner 24 which would be readily apparent upon re-opening door 20. However, in accordance with the present invention, it is desired to provide a trim member about top plate portion 105 to cover any such gaps. FIG. 2 shows one embodiment of this aspect of the invention wherein a trim member 195 is formed as part of top plate portion 105. More specifically, trim member 195 includes a first side 197 that extends directly adjacent support legs 115 and 116, a second side 198 which extends directly along main body portion 161 of inner liner 24 and an angled side 199 which is visually exposed. In accordance with this embodiment, trim member 195 is connected to support legs 115 and 116 of top plate portion 105 through a living hinge 205. With this arrangement, once dispenser assembly 28 is positioned in the manner shown in FIG. 2 with support legs 115 and 116 of top plate portion 105 resting upon main body portion 161 of inner liner 24, living hinge 205 will enable automatic pivoting of trim member 195 such that first side 197 will extend directly adjacent support legs 115 and 116, and second side 198 will extend directly along and actually be biased against main body portion 161 of inner liner 24. Therefore, trim member 195 establishes a peripheral trim member that is constituted by a flexible skirt defined by a thin flange section extending outwardly at an angle from a periphery of top plate portion 105 through living hinge 205. In this fashion, trim member 195 extends along inner liner 24 and covers any gap between inner liner 24 and dispenser assembly 28. Therefore, the inclusion of the trim member constitutes another aspect of the invention, with these aspects synergistically combining to provide long term sealing and assuring an overall aesthetic mounting arrangement for dispenser assembly 28.

Figure 3:
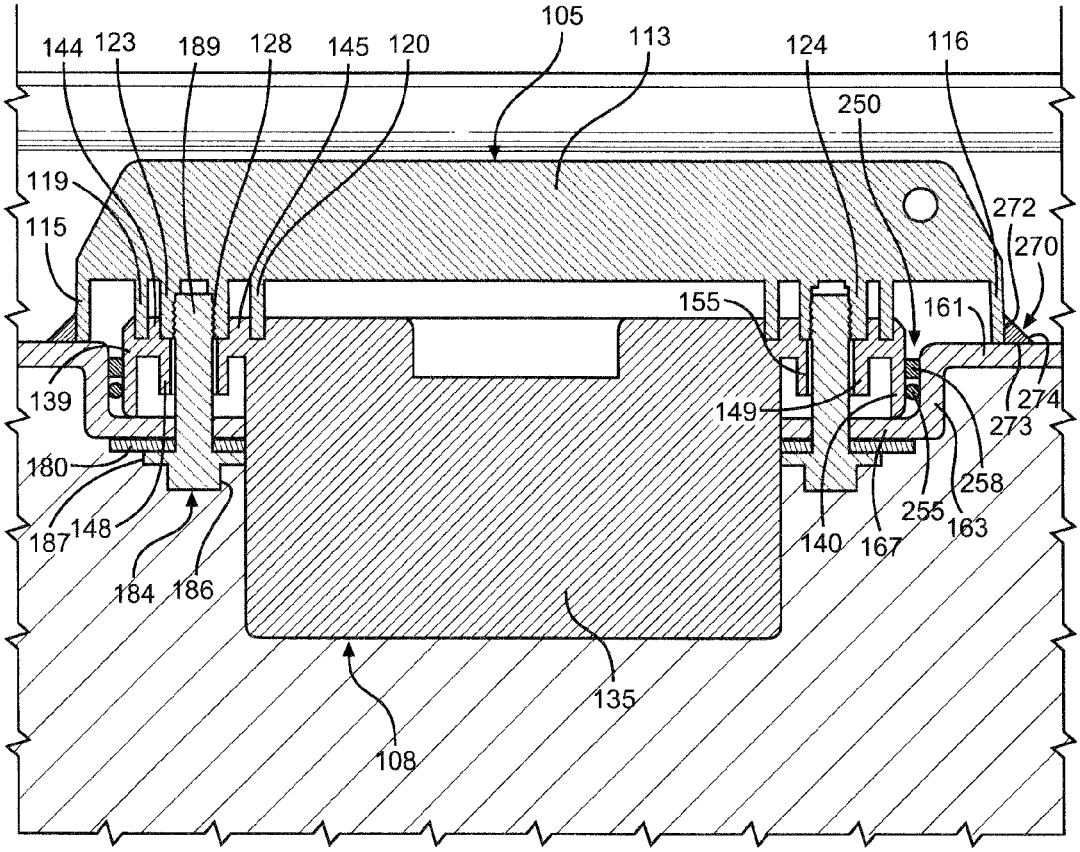
FIG. 3 is a cross-sectional view of another embodiment of the dispenser assembly of the invention.

The various aspects of the invention as set forth above can be accomplished in numerous ways without departing from the invention. FIG. 3 shows another embodiment wherein like reference numerals referring to corresponding parts. In general, much of the structure of this embodiment is identical to that described above with respect to FIG. 2. However, instead of employing face seal 192, the embodiment of FIG. 3 employs a radial seal generally indicated at 250. As shown, radial seal 250 is located between support legs 139 and 140 and in-turned portion 163 of inner liner 24. In the particular embodiment shown in FIG. 3, radial seal 250 is actually established by an O-ring 255, as well as a flat-ring 258. At this point, it should be recognized that either or both of O-ring 255 and flat-ring 258 can be utilized. In any case, with this embodiment, mechanical fasteners 184 still directly interconnect inner liner 24 with top plate portion 105 while extending freely through bosses 148 and 149 of rear plate portion 108. In addition, it is the combination of primary seal 180 and radial seal 250 which prevents any undesired leakage between inner liner 24 and outer panel 22 of door 20.

The embodiment of FIG. 3 also differs from the arrangement of FIG. 2 by the inclusion of a trim member 270 in place of trim member 195. In accordance with this embodiment, peripheral trim member 270 is constituted by a separate component from top plate portion 105 and preferably snaps or is otherwise attached about top plate portion 105 such that a first side 272 of trim member 270 snuggly fits about support legs 115 and 116 of top plate portion 105, a second side 273 of trim member 270 seats upon main body portion 161 of inner liner 24 and an angled side 274 of trim member 270 is exposed. Again, in a manner directly analogous to trim member 195, trim member 270 extends along inner liner 24 and covers any gap between inner liner 24 and dispenser assembly 28. Mainly, the distinction between these embodiments regarding the trim members concerns trim member 270 being a separate element and preferably being formed of an elastomeric material which is snap-fit about main body portion 113 of top plate portion 105.

Although described with reference to preferred embodiments of the invention, it should be readily understood that various changes and/or modifications can be made to the invention without departing from the spirit thereof. Certainly, it should be recognized that the objects of the invention can be carried out in various different ways. In particular, it should be recognized that either one of the face seal or the radial seal can be used with either trim member. In fact, although considered somewhat redundant, both the face and radial seals could be used together and in combination with either trim member. In addition, although described with reference to a dishwasher having a pivoting door to seal off the frontal opening of a tub, the invention could also be employed in connection with a drawer dishwasher, such as by mounting the dispenser assembly to the inner tub liner. In any case, in general, the invention is only intended to be limited by the scope of the following claims.

What is claimed is:

1. A dishwasher comprising:

a tub including bottom, rear and opposing side walls defining a washing chamber having a frontal opening;

a dish rack adapted to support kitchenware to be washed in the washing chamber;

at least one spray arm mounted within the tub for spraying washing fluid toward the dish rack during a washing operation;

a door mounted for movement relative to the tub for selectively closing the frontal opening of the washing chamber, said door including an outer panel and an inner liner; and a dispenser assembly including:

a top plate portion;

a rear plate portion;

at least one internal storage compartment for housing a washing agent;

at least one mechanical fastener mounting the dispenser assembly to the inner liner of the door, with the at least one mechanical fastener extending freely through the rear plate portion and being secured to the top plate portion such that the rear plate portion is sandwiched between the top plate portion and the inner liner;

a seal being disposed between the inner liner and the rear plate portion; and a trim member provided about a periphery of the top plate portion and seating upon the inner liner.

2. The dishwasher of claim 1, further comprising: a primary seal interposed between a head portion of the at least one mechanical fastener and the inner liner.

3. The dishwasher of claim 2, wherein the at least one mechanical fastener is threadably attached directly to the top plate portion.

4. The dishwasher of claim 1, wherein the at least one mechanical fastener also extends through the seal.

5. The dishwasher of claim 4, wherein the seal constitutes a flat seal positioned between at least one boss of the rear plate portion, through which the at least one mechanical fastener freely extends, and the inner liner.

6. The dishwasher of claim 1, wherein the seal constitutes a radial seal radially positioned between a peripheral portion of the rear plate portion and the inner liner.

7. The dishwasher of claim 6, wherein the radial seal is defined by at least one of an O-ring seal and a flat ring seal.

8. The dishwasher of claim 1, wherein the trim member is attached to the top plate portion through a living hinge.

9. The dishwasher of claim 1, wherein the trim member constitutes a separate component from the top plate portion.

10. A dishwasher comprising:

a washing chamber defined, at least in part by an inner liner of the dishwasher and having an opening for inserting and removing kitchenware for a washing operation; and a dispenser assembly including:

a top plate portion;

a rear plate portion;

at least one internal storage compartment for housing a washing agent; and at least one mechanical fastener mounting the dispenser assembly to the inner liner, with the at least one mechanical fastener extending freely through the rear plate portion and being secured to the top plate portion such that the rear plate portion is sandwiched between the top plate portion and the inner liner.

11. The dishwasher of claim 10, wherein the at least one mechanical fastener is threadably attached directly to the top plate portion.

12. The dishwasher of claim 11, further comprising:

a primary seal interposed between a head portion of the at least one mechanical fastener and the inner liner; and a secondary seal disposed between the inner liner and the rear plate portion.

13. The dishwasher of claim 12, wherein the at least one mechanical fastener also extends through each of the primary seal and the secondary seal.

14. The dishwasher of claim 12, wherein the secondary seal constitutes a flat seal positioned between at least one boss of the rear plate portion through which the at least one mechanical fastener freely extends and the inner liner.

15. The dishwasher of claim 12, wherein the secondary seal constitutes a radial seal radially positioned between a peripheral portion of the rear plate portion and the inner liner.

16. The dishwasher of claim 15, wherein the radial seal is defined by at least one of an O-ring seal and a flat ring seal.

17. The dishwasher of claim 10, further comprising: a trim member provided about a periphery of the top plate portion and seating upon the inner liner.

18. The dishwasher of claim 17, wherein the trim member is attached to the top plate portion through a living hinge.

19. The dishwasher of claim 17, wherein the trim member constitutes a separate component from the top plate portion.

20. A method of mounting a dispenser assembly, including a top plate portion and a rear plate portion, to an inner liner of a dishwasher door comprising:

positioning a seal between the rear plate portion and the inner liner; and extending at least one mechanical fastener through the inner liner, freely through the rear plate portion and securing the at least one mechanical fastener directly to the top plate portion.

21. The method of claim 20, further comprising: positioning a trim member about a periphery of the top plate portion, with the trim member seating upon the inner liner, to cover gaps between the top plate portion and the inner liner.

22. The method of claim 21, further comprising: pivoting the trim member relative to the top plate portion to position the trim member about the periphery of the top plate portion.

23. The method of claim 20, further comprising: extending the at least one mechanical fastener through the seal.

24. The method of claim 20, further comprising: positioning the seal radially between the rear plate portion and the inner liner.

* * * * *